United States Patent [19]

Mills et al.

[11] Patent Number: 4,709,929

[45] Date of Patent: Dec. 1, 1987

[54] GAME BOARD

[76] Inventors: Russell C. Mills, 113 Oak, Elmhurst, Ill. 60126; Stewart C. Jager, 266 W. Norman, Wheeling, Ill. 60090

[21] Appl. No.: 28,965

[22] Filed: Mar. 23, 1987

[51] Int. Cl.[4] ..... A63B 67/00

[52] U.S. Cl. ..... 273/402

[58] Field of Search ..... 273/401, 402, 348, 353, 273/347, 1 A

[56] References Cited

U.S. PATENT DOCUMENTS

| | | | |
|---|---|---|---|
| 324,189 | 8/1885 | Thomas . | |
| 406,342 | 7/1889 | Dumont | 273/402 |
| 2,050,914 | 8/1936 | Anderson | 273/102 |
| 2,206,848 | 7/1940 | McAvoy | 220/46 |
| 2,291,104 | 7/1942 | Radzyner | 35/22 |
| 3,504,787 | 4/1970 | Brockway | 206/12 |
| 3,628,793 | 12/1971 | Mudloff | 273/105 |
| 3,749,401 | 7/1973 | Hayko | 273/95 |
| 3,876,070 | 4/1975 | Nagy | 273/348 X |
| 4,012,042 | 3/1977 | Blasingame | 273/401 |
| 4,204,682 | 5/1980 | Brown | 273/401 |
| 4,243,229 | 1/1981 | Huser et al. | 273/402 |
| 4,392,653 | 7/1983 | Blume, Sr. | 273/400 |
| 4,565,375 | 1/1986 | Dresel | 273/401 |

FOREIGN PATENT DOCUMENTS 455557 10/1936 United Kingdom ..... 273/347

OTHER PUBLICATIONS

Placo Products Co. advertising circular 3-1970, items Nos. 430 & 440.

Popular Mechanics, vol. 110, No. 2, 8-1958, p. 178, Sandpaper Target.

*Primary Examiner*—Paul E. Shapiro

*Attorney, Agent, or Firm*—Dority & Manning

[57] ABSTRACT

A game board for use as a toss game target. The board is generally rectangular and provides a target surface which includes upraised wall sections and complementary shutter members for differentially contacting and engaging playing pieces such as sacks tossed thereat. The upraised wall sections define a substantially geometrically-shaped area, which is further associated with a substantially centralized main scoring opening defined in the target surface. A pair of such game boards may be separably engaged with one another for portability and storage thereof, with a cavity portion defined therebetween for further storage of playing pieces and removable leg elements. When in play, the game boards may be supported on such leg elements, disposed in an elevated and angled position.

20 Claims, 6 Drawing Figures

Fig. 2
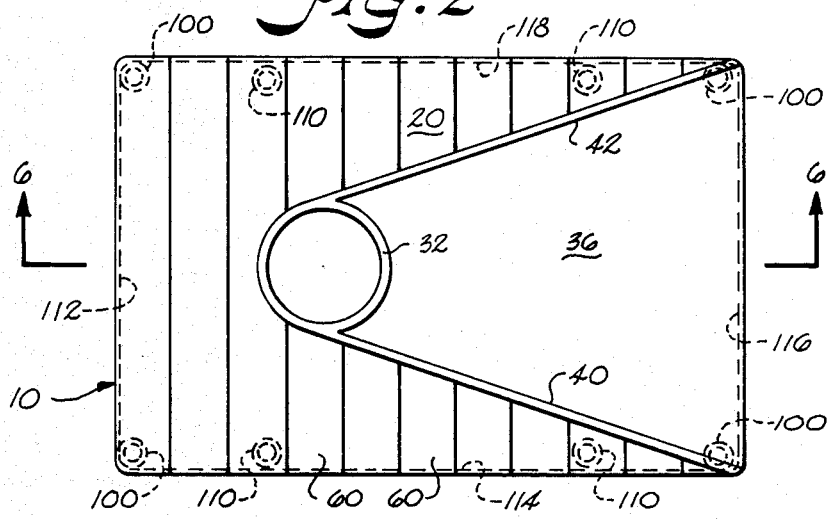
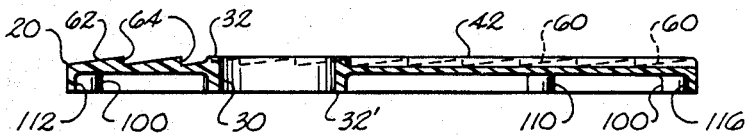
Fig. 6
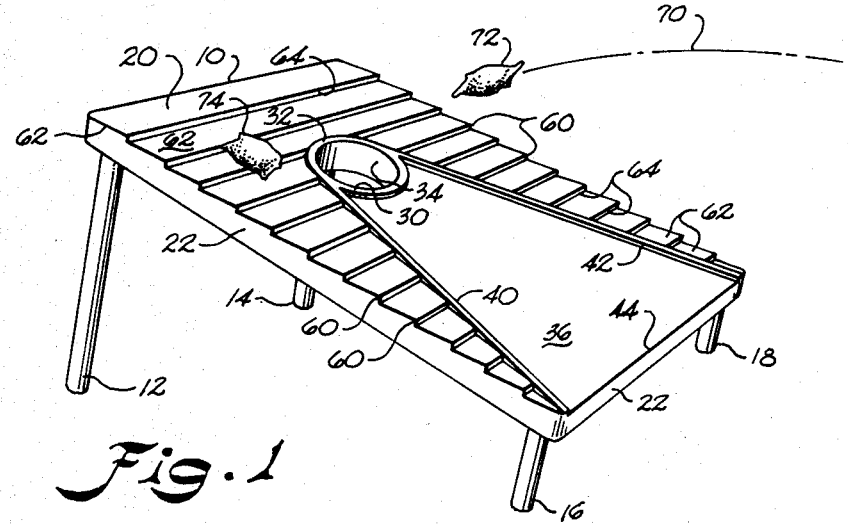
Fig. 1

GAME BOARD

BACKGROUND OF THE INVENTION

The present invention in general concerns a board for playing games, and in particular is directed to a game board adapted to provide a target surface for playing pieces to be thrown thereat.

Skill games which incorporate the tossing of rings, discs, sacks or the like towards a scoring opening or a board having differentiated scoring areas have been popular for many years. In general, such toss-type skill games involve the throwing of a designated playing piece or pieces towards a target surface, or particular areas or openings thereof. Often the objects and rules of a particular game vary somewhat in dependence on the configuration or structure of the target surface itself.

Examples of U.S. patents disclosing various skill games involving the tossing of a playing piece include:

| U.S. Pat. No. | INVENTOR(S) | DATE OF ISSUE |
|---|---|---|
| 4,392,653 | Blume, Sr. | July, 1983 |
| 4,243,229 | Huser et al. | January, 1981 |
| 4,204,682 | Brown | May, 1980 |
| 3,749,401 | Hayko | July, 1973 |
| 3,628,793 | Mudloff | December, 1971 |
| 2,050,914 | Anderson | August, 1936 |
| 324,189 | Thomas | August, 1885 |

In general, each patent discloses various features and structure considered by its respective inventor(s) to hold particular advantages. For example, Anderson discloses a game board supported on legs secured thereto with socketed bearing arrangements. Some of such legs have springs therearound to resiliently support the game board for accepting the shock or jarring caused by tossed discs striking the playing surface. Also, ring-like grooves formed on the playing surface to designate scoring areas are countersunk beneath the playing surface to avoid damage to such scoring area designations through normal contact during play with discs or rings tossed thereat.

Mudloff provides another example of a toss game with particular features, wherein two wedge-shaped half-sections (which separable may serve as two targets) are assembled with suitcase-type fasteners for transportation and for storage of playing piece sand bags inside the assembled box-like structure.

While some games provide an unimproved (eg. flat) surface as an alternative or apron landing area for tossed playing pieces adjacent a primary scoring target (i.e. an opening, cup or the like), such games can prove frustrating to players since it may be relatively difficult to provide controlled placement of the thrown playing piece adjacent but not in the primary scoring area. Even if the smooth or unimproved landing area is disposed at an angle of rest to the incoming playing pieces, such pieces can slide and bounce considerably from their original point of impact (even to the point of falling off the target area). Such difficulty is exacerbated as the distance between the player and the target increases. While some fortune or elements of chance are nearly always involved, players prefer and have a greater sense of enjoyment for toss games where there respective skills may be challenged and competitively compared.

However, it would be generally undesirable in some instances to provide a game board to which tossed objects stuck completely and exactly at the point where they landed. For example, in certain games great excitement and challenge arises if subsequent throws by different players are permitted to hit and dislodge previous thrown pieces from favorable scoring areas.

SUMMARY OF THE INVENTION

The present invention concerns an improved game board, which in general improves play therewith by the configuration of a target or support surface which it provides. In particular, such support surface improves play therewith by facilitating the reception thereon of playing pieces tossed thereat. Particular structural features, generally including a combination of both upraised wall-like structures and upraised shutter or baffle-like structures, enable players to utilize their tossing skills to toss playing pieces onto a game board having relatively predictable playing piece-engagement characteristics.

It is one object of the present invention to provide an improved game board having predetermined structures formed thereon which improve the overall playing characteristics of the game by the particular and generally predictable engagement characteristics thereof responsive to playing pieces tossed thereat.

Various upraised members on the present game board provide frictional (i.e. contact) engagement with playing pieces tossed thereat for braking and guiding same, resulting at least in part in the improved play described herein.

A further object of the present invention is to enhance play with such a game board by providing different areas on the target surface having differentiated engagement characteristics, whereby more favorable landing areas of determined size and relationship may be designated and provided. While providing such improved game board apparatus it is a further object of this invention to provide an even more enjoyable game board for use by players whose skill level permit their taking advantage of such differentiated areas, and to also take advantage of further features of the target surface wherein subsequent tosses (or shots) are permitted to dislodge or defeat earlier shots.

While improved playing features form one object of the present invention, other aspects thereof concern further objects of this invention. For example, it is yet another object of this invention to provide a pair of such improved game boards having features which permit their separation for play, but attachment with each other for ease of portability.

In one exemplary embodiment, the present game boards are generally planar in form. Particularly in such instance, it is a further feature of this invention to provide such game board so as to define storage space therebetween when joined. Such storage space may be sufficient to receive playing pieces therefor, as well as removable support means usable therewith, as discussed further below.

While various objects and features of the present invention are more particularly disclosed below, different modifications and variations thereto may be made by one of ordinary skill in the art, including but not limited to reversal of parts of the structures or functions, or the replacement of given elements of the invention with equivalents thereof.

Furthermore, various features and aspects presently disclosed herewith may be combined so as to form a given embodiment of the present invention. One exemplary embodiment of this invention is directed to a game board for use as a target for thrown playing pieces, comprising a support surface having a predetermined shape, and respective front and back sides; and first and second scoring areas respectively defined on complementary portions of the front side of the support surface; wherein the first scoring area includes predetermined geometrically-shaped sub-areas therein; and the second scoring area includes a plurality of upraised generally shutter-like members dispersed substantially throughout the second area, such shutter-like members being adapted for contact and engagement with playing pieces thrown thereat.

Further objects and aspects of the present invention, including alternative embodiments thereof, will be understood by those of ordinary skill in the art upon studying the remaining disclosure herewith.

BRIEF DESCRIPTION OF THE DRAWINGS

A complete and enabling disclosure of the present invention, including the best mode thereof, is set forth more particularly in the following specification, in conjunction with the appended figures, in which:

FIG. 1 illustrates a perspective view of a game board in accordance with one embodiment of the present invention, placed in an exemplary playing position and supported on removable legs;

FIGS. 2 and 3 illustrate top and bottom plan views, respectively, of the game board embodiment of the present invention illustrated in present FIG. 1;

FIG. 6 illustrates a longitudinal cross-section of the game board illustrated in present FIG. 2 in accordance with the sectional lines thereof.

Figure 3:
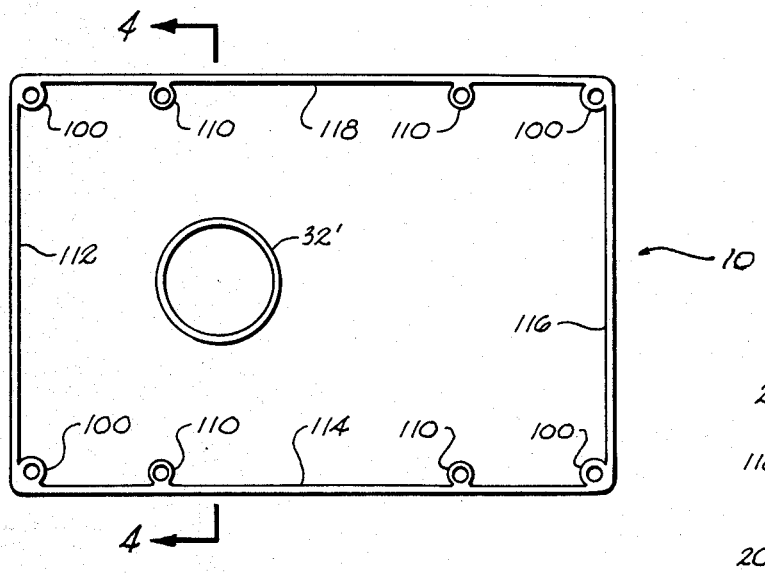

Like use of reference characters throughout the present disclosure and associated drawings is intended to indicate same or analogous features or elements of the present invention.

DETAILED DESCRIPTION OF THE PREFERRED EMBODIMENT

FIG. 1 illustrates a game board 10 having features generally in accordance with an exemplary presently preferred embodiment of the present invention. Furthermore, such game board is positioned in a preferred placement for playing by being supported on legs 12, 14, 16, and 18. Such legs are removably engaged with a bottom surface of game board 10, as discussed in greater detail below.

As apparent from FIG. 1, rearward legs 12 and 14 are generally longer than front legs 16 and 18 so as to provide a predetermined angle of rest for the board 10 at a given distance above a support surface, such as a floor (if used inside) or the ground (if placed outside). Such legs may comprise plastic tubing of about 1 inch outside diameter, or any suitable equivalents thereof. Various angles of rest for game board 10 are included features of the present invention, but it is preferred that front legs 16 and 18 be about 6 inches in length while back legs 12 and 14 are about 16 inches in length. Such length in conjunction with the size of the rectangle defined by game board 10 forms the angle of rest thereof. The preferred size of such rectangle is approximately 32 inches by 22 inches, although variations in such rectangle size and the length of the legs may be practiced. Of course, game board 10 is not strictly limited to a rectangular shape, although such shape is preferred for the presently illustrated embodiment.

Game board 10 may be formed from a variety of materials such as wood, fiberglass, or plastics, but plastics are generally preferred as a good balance of strength, durability, weight, and cost characteristics. Also, it is preferred that a playing or target surface 20 of game board 10 be generally planar, and have various features integrally associated therewith or attached thereto. Generally planar target or support surface 20 may have an apron or edging 22 integrally formed or otherwise attached thereto. Such edging may provide strength and rigidity for surface 20, and also perform functions concerning other aspects of the present invention (particularly as illustrated and discussed in connection with present FIG. 5). While numerous variations may be practiced, it is preferred that planar surface 20 have a thickness of approximately 1/16 of an inch, while edging 22 has a width of about 1¼ inches.

Additional features may be provided on an upper side of target surface 20 more particularly concerned with contact and the engagement of playing pieces (such as filled bags) tossed thereat. In particular, and in accordance with the presently preferred exemplary embodiment, such additional features may take the form of combinations of upraised shutter-like and upraised wall-like elements integrally formed on or attached to the front or top surface 20 of game board 10.

Preferably generally centralized in target surface 20 is a main scoring opening 30 (preferably completely therethrough) which includes an upraised rim area 32 and extending cylinder area 34. Generally centralized in this instance does not mean that opening 30 is precisely in the center of board 10, though it could be. Nor is the location of opening 30 necessarily limited to a generally centralized or even a central region location; an off-set position may also be effectively practiced. Such cylinder area may typically have a width approximately the same as the width of side edging 22, and thus also projects below the bottom side of target surface 20.

The other upraised wall-like elements formed on target surface 20 of game board 10 may preferably define a geometrically-shaped structure, which in predetermined orientation with primary scoring opening 30 form a first target or scoring area 36 (i.e. preferred or favored landing area) on surface 20. Upraised members 40 and 42 are generally tangential to and cooperate with circular upraised member 32 and a base portion or edge 44 of game board 10 so as to substantially define a triangular-shaped structure. Included within such triangle 44 is circular opening 30 at the top of such triangle.

It is further apparent from FIGS. 1 and 2 that, proceeding from base 44 towards primary opening 30, sidewalls 40 and 42 generally form structure which defines a throat-like configuration substantially pointed in the direction from which playing pieces are preferably thrown towards primary scoring opening 30. Such structure generally defined by the upraised wall elements contributes to improved playing characteristics of game board 10, particularly when utilized with bean bag or sand-filled bags (as generally illustrated in FIG.

1). In part, such improved play (and hence increased enjoyment thereof) is derived from the psychological and structural directive forces of upraised side walls 40 and 42 angling inward towards primary scoring opening 30, and from the favored first scoring area thereby psychologically and structurally formed.

The focusing function achieved by the presently preferred embodiment is complemented by the playing piece engagement characteristics of the surface of scoring area 36, which during anticipated play is preferably disposed at an angle to the direction of travel of tossed playing pieces (see present FIG. 1). Such arrangement desirably imparts a stopping force to tossed playing pieces, but over a decreasing width field as the playing piece approaches the primary scoring target (i.e. opening 30). If desired, various indicia (or other means for defining sub-areas) may be provided in scoring area 36 to effect differentiated scoring values for different distances within scoring area 36 from main scoring opening 30.

If preferred, virtually all of the upraised wall-like structures present on the upper surface of game board 10 may be provided with slightly rounded edges so as to prevent or lessen any possibility of damage to playing pieces thrown thereat.

A second target or scoring area is defined by those portions of target surface 20 which are generally complementary to the geometrically-shaped first scoring area enclosed within upraised side walls 40 and 42 (inclusive of circular member 32 and its enclosed scoring opening 30). Such second scoring area is preferably provided with a plurality of upraised shutter-like members 60, which preferably have an elevated end height approximately equivalent to that of the upraised wall-like members, discussed above.

Upraised members 60 (in the embodiment presently illustrated) are fairly uniformly disposed over the entire area complementary to the geometrically-shaped first scoring area. Such configuration provides substantially uniform playing piece contact or engagement characteristics over the entire affected area, but such characteristics will be different from those within or related to the above-described first scoring area (as readily understood by those of ordinary skill in the art upon visual inspection of same).

Each member 60, in this exemplary embodiment, includes a first planar surface 62 generally inclined with respect to substantially planar support surface 20, and a second planar surface 64 substantially perpendicular to surface 20 and extending between surface 20 and an elevated end of its respective surface 62. Such members 60 are, as illustrated, preferably placed in parallel with each other and perpendicular to the intended direction in which a playing piece is tossed thereat. Accordingly, the shutter-like members 60 define a baffle-type configuration having a saw-tooth shaped longitudinal cross-section situated so as to check or brake playing pieces tossed thereat.

While FIG. 1 illustrates the placement of a game board 10 in a preferred playing disposition, dotted line pathway indication 70 thereof illustrates a preferred flight path of a playing piece 72 thrown towards game board 10 by a player or the like. Such pathway is primarily directed towards the main scoring opening 30, by which the highest point possibility is ordinarily achieved in horseshoe-like games which may be played with the present game board. Playing piece 74 illustrates a playing piece which has already been thrown and has landed on game board 10 in the area of upraised shutter-like members 60 thereof. As is apparent, like or equivalent playing pieces may be thrown, received, and supported on virtually any upper surface area of game board 10. As is readily understood by those of ordinary skill in the art, different players may use similar but distinguishable playing pieces (eg., different colored bean bags), and alternate turns throwing their respective playing pieces towards the multiple target areas provided by game board 10.

FIG. 1 illustrates merely one preferred exemplary embodiment of the present invention illustrated in a preferred playing position thereof. Hence, while bean bag-type toss playing pieces are preferably thrown in the direction of primary scoring opening 30 in such manner so as to traverse the above-described throat-like structure, it is understood that various modifications and variations which would occur to one of ordinary skill in the art may be practiced in conformance with the broader teachings of the present invention.

Referring now to FIGS. 2 and 3, a top plan view and a bottom plan view are respectively illustrated for the embodiment presently shown in FIG. 1. In general, analogous or like features are represented by the same reference characters as set forth in present FIG. 1, and thus a complete re-description thereof is not required.

In particular, FIG. 2 illustrates a top plan view of game board 10 more clearly showing the orientation of shutter-like members 60 relative the remaining upraised wall-like members on surface 20. Furthermore, the geometrical shapes defined by circular upraised member 32, sidewalls 40 and 42, are more clearly illustrated by present FIG. 2.

FIG. 2 also illustrates various features of game board 10 in dotted line, all of which indicate reverse side features of target surface 20. For example, four sockets or receptacles 100 are formed on the bottom side of game board 10 and adapted to selectively and separably receive leg members 12–18 therein. In general, such legs engage receptacles 100 in relatively rigid relationship to provide a stable platform for target surface 20.

Additional dotted line indications 110 illustrated in FIG. 2 comprise attachment means which permit a pair of game boards 10 to be joined in back-to-back relationship for ease of portability. Such attachment elements 110 may alternately comprise male and female connectors (with receptacles and projecting members being preferred), or virtually any other type of suitable elements for separably attaching such pair of game boards. Present FIGS. 1–4 and 6 illustrate a single game board 10, while present FIG. 5 more fully illustrates a pair of such game boards as separably engaged by such attachment elements 110 (more fully discussed below in conjunction with FIG. 5). The additional dotted line structures 112, 114, 116, and 118 of FIG. 2 are representative of the inside surfaces of side members 22 depending from target surface 20 of game board 10, and hence illustrate the approximate thickness of such side members.

Referring now to a bottom view of the exemplary embodiment of FIG. 1, FIG. 3 illustrates in solid line a number of the bottom surface features of game board 10 represented in dotted line in FIG. 2. For example, leg receiving elements 100 and attachment means 110 may be partially formed integrally with the depending side wall members 112, 114, 116, and 118 for additional strength. The various positions and overall configuration of receptacles 100 and attachment elements 110 is preferably as illustrated in FIG. 3, but may be variously modified by one of ordinary skill in the art without departing from the scope or spirit of the present invention. Several important considerations is that the placement of receptacles 100 or the like should be sufficient to provide stable support for board 10 with removable leg means attached thereto, and the nature of attachment elements 110 should be sufficient to provide reliable but separable attachment of a pair of game boards 10.

Figure 4:
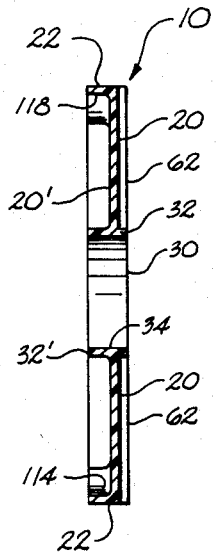
FIG. 4 illustrates a side cross-sectional view of the game board illustrated in present FIG. 3 in accordance with the sectional lines thereof.

FIG. 3 further illustrates the rim portion 32' of circular projection 34 which is apparent from a bottom plan view of the embodiment of FIGS. 1 and 2. Such relationship of rims 32 and 32', and channel 34 is shown in greater detail by the cross-sectional view shown by FIG. 4, as taken along the sectional lines 4—4 indicated in FIG. 3. FIG. 4 is generally taken through the center of opening 30, and thus illustrates a portion of such opening in relationship with target surface 20 of game board 10. In addition to illustrating a front side of target surface 20, a reverse side thereof 20' generally includes integrally formed therewith depending members 118 and 114, which serve to define the side rim or side walls 22 illustrated in present FIG. 1. Depending members 112 and 116 would be similarly formed with relation to reverse side 20', but are not seen in the view illustrated by FIG. 4. A portion of an inclined surface 62 of a transverse shutter-like member 60 is shown by the cross-section of FIG. 4.

Figure 5:
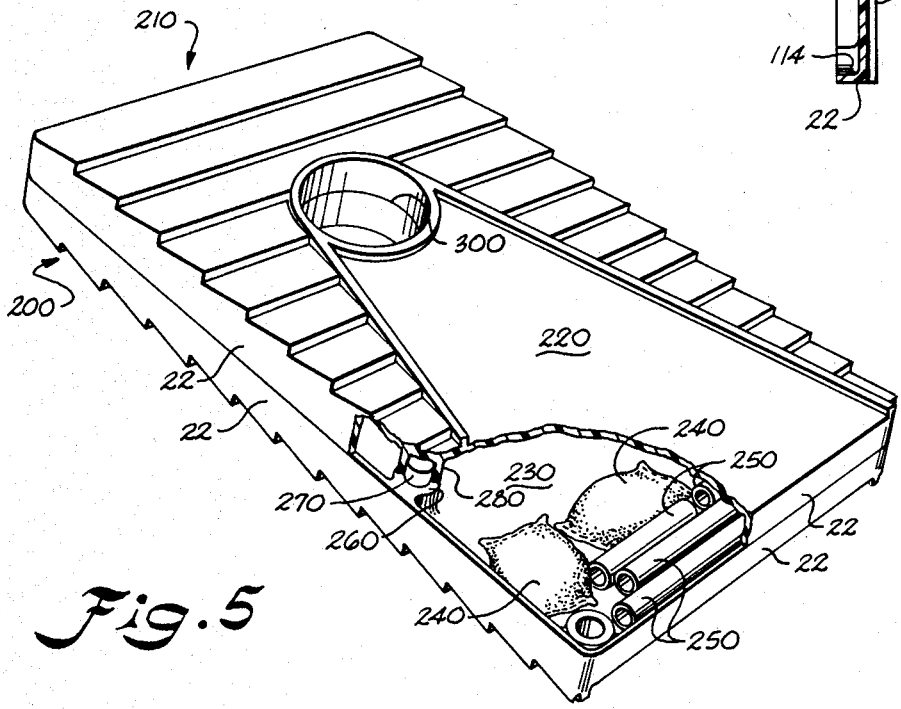
FIG. 5 illustrate a pair of game boards, each generally similar to the game board embodiment of present FIG. 1, separably engaged in back-to-back relationship, and with paraphernalia associated therewith stored in a chamber defined by the assembled pair of game boards.

FIG. 5 illustrates a pair of game boards 200 and 210, generally in accordance with the exemplary embodiment of game board 10 of FIG. 1, separably engaged in back-to-back relationship. Such configuration facilitates handling and portability of a pair of the game boards, particularly in view of the corresponding alignment of the respective primary scoring openings of each game board so as to form a carrying handle 300 extending through the assembled game boards. The surface features of game board 200 (not shown) are understood to be preferably similar to those of game board 210, as illustrated, which features need not be described in detail since they are essentially the same as those for the exemplary embodiment of FIG. 1. Of course, similar sized boards with different target surface features could be attached for transportation, generally as indicated.

A portion of target surface 220 of game board 210 is cut away to permit illustration of a cavity 230 formed between game boards 200 and 210 when such pair are assembled. Such cavity need not be of appreciable thickness, since it is generally desirable to provide such game boards in a substantially planar configuration, with depending side members 22 in the range of only about 1 inch. However, even a cavity of only about 2 inches thickness (and even less) is typically ample to permit storage of playing pieces 240 and legs 250 therein.

Furthermore, since carrier handle 300 is essentially formed entirely through the assembled pair of game boards with their respective inner circular areas (eg. rims 32') in facing contact, playing pieces 240 and removable leg members 250 are essentially fully enclosed when received within cavity 230. Thus, some protection against adverse weather conditions, such as rain, wind or the like, will be afforded to the enclosed playing pieces and legs even should the assembled game boards be left outdoors. Of course, convenient storage of the required playing pieces and the optional support legs with the pair of game boards (as illustrated by present FIG. 5) greatly facilitates storage of all the desired elements for play.

In the exemplary configuration of FIG. 5, game boards 200 and 210 may be separably engaged with one another with a plurality of attachment elements, one of which is illustrated as a bracket 260 integrally formed with game board 200, and a further projecting member 270 integrally formed or otherwise associated with bracket 260. Game board 210 then has a corresponding receptacle 280 integrally formed therewith, which receives and engages projecting member 270, by which engagement the game boards 200 and 210 are separably held with one another. Of course, board 200 could alternately be provided with the receptacle and board 210 provided with the corresponding projection member. Also, equivalent variations of such attachment elements for separably attaching two game boards together may be substituted by one of ordinary skill in the art. In any instance, proper tolerances for such attachment elements may be readily provided during manufacture of game boards 200 and 210 so that such game boards may have a simple snap-fit with one another.

FIG. 6 illustrates a longitudinal cross-section of the embodiment of FIG. 2 as indicated by the sectional lines thereof. Opening 30 includes upper and lower circular rims 32 and 32', respectively. End flange members 112 and 116 depend perpendicularly from support surface 20. Sidewall 42 is shown in transparent view so that shutter-like members 60 may be seen therebehind in dotted line. Collectively, members 60 have a longitudinal cross-section ,which defines a saw-tooth shape, which results from the contiguous placement of their alternating first surfaces 62 and second surfaces 64.

While structure in accordance with an exemplary embodiment of the present invention has been discussed above in detail, the preferred and enhanced game playing use thereof is set forth more particularly below. First, it should be understood that the foregoing structure and all equivalents thereof form embodiments of the present invention, without limitation to the nature of the playing pieces used, whether support legs are used, or whether particular game rules or point value designations for scoring areas or sub-areas are made.

Though it is not required, it is preferred that a pair of game boards be used, with same displaced from one another by a desired distance (for example, 20–50 feet) for play in a manner similar to the displacement of upraised stakes for use in the well-known game of horseshoes. When not in use, such pair of game boards may be preferably stored in the manner illustrated in FIG. 5 (i.e. in back-to-back separable relationship, with playing pieces and removable legs therefor stored within a cavity defined between the two game boards). Of course, various alternative orientations, such as front-to-back relationships, may be established, with or without enclosed storage of the playing pieces and removable legs. In further alternative, all or some of the separable elements of FIG. 5 may even be separately stored.

Whenever play is desired, the pair of game boards (or even a single game board) may be set up in a playing position. Such playing position preferably is as illustrated in present FIG. 1, whereby the target surface 20 of the game board is disposed at both an elevated and angled dispostion relative the surface upon which the respective legs are supported. However, while such disposition is preferred for some of the reasons stated below, the game board may be alternatively propped up on any type of elevating elements, or the board may rest entirely flat on a support surface.

One advantage in providing an elevated target surface is that it can be determined unquestionably whenever tossed playing pieces have passed through the primary scoring opening 30. Of course, a given game board need not be fully elevated above a support surface to achieve such object. For example, legs may be omitted altogether for the front receptacles generally associated with base 44 of game board 10, and the shorter removable legs 16 and 18 used in place of longer legs 12 and 14 on the back receptacle positions. Such configuration still provides both a degree of elevation to permit determination with certainty whether a playing piece has passed through primary scoring opening 30 (and ease in retrieving such piece), and at least a degree of angled disposition for enhanced visibility and play characteristics (particularly for longer-distance throws).

Variations in play (i.e. use of playing pieces 72 and 74 or equivalents thereof) may be provided virtually without limitation. For example, a higher number of points may be provided for tosses resulting in a playing piece passing through the primary scoring opening, with lower point totals being established for tosses resulting in a playing piece resting on the target surface (such as playing piece 74 of FIG. 1), but not in a predetermined scoring area. Additionally, various areas may be defined by elements of present FIG. 1 and respectively designated with varying score values, particularly with the smaller areas being designated with relatively higher point values than the larger areas.

Players may take turns throwing distinguishable (eg. by color) playing pieces, such as sand bags or bean bags, or other suitable playing pieces. In any event, once play is completed, the various leg assemblies (if used) associated with the game board (of whatever nature) may be separated therefrom and the legs (if used) and playing pieces stored within a pair of assembled game boards, as illustrated by present FIG. 5. Of course, not all possible rules of play are included or even suggested herein. Furthermore, individual players are not restricted from establishing their own rules, and even their own uses (and placement) of the game board(s).

Various modifications and variations to the presently illustrated preferred embodiment of such game board will occur to those of ordinary skill in the art, and all such modifications and variations are intended to fall within the scope and spirit of the present invention. For example, opening 30 may instead be formed as a cup (much like a golf hole) for capturing tossed playing pieces. Or, the overall shape of a game board, or its geometrical surface structures may be varied. Furthermore, more than one scoring opening could be provided, or even more than one planar surface (eg. a multi-tiered board) could be provided as a game board. Moreover, the description of the exemplary embodiment set forth above is intended as words of description and example only, and not words of limitation, which may be found only in the appended claims.

What is claimed is:

1. A game board for use as a target for thrown playing pieces, comprising:

a support surface having a predetermined shape, and respective front and back sides; and first and second scoring areas respectively defined on complementary portions of said front side of said support surface; wherein said first scoring area includes predetermined geometrically-shaped sub-areas therein; and said second scoring area includes a plurality of upraised generally shutter-like members dispersed substantially throughout said second area, said shutter-like members being adapted for contact and engagement with playing pieces thrown thereat.

2. A game board as in claim 1, including at least two of said sub-areas, which two sub-areas are of differing size, with the smaller thereof constituting a primary scoring sub-area which is included within the other, larger sub-area.

3. A game board as in claim 2, wherein said larger sub-area is generally triangular-shaped, and said smaller sub-area is generally circular and substantially integrated into one of the tips of said larger sub-area, resulting in at least one somewhat rounded tip therefor.

4. A game board as in claim 3, wherein said support surface defines a generally circular primary scoring opening therethrough co-existent with said smaller sub-area, and the base of said triangular-shaped sub-area which is opposite said one rounded tip thereof is co-existent with an edge of said support surface.

5. A game board as in claim 1, wherein said shutter-like members each include a first planar surface inclined to said support surface, and a second planar surface perpendicular to said support surface and interconnecting between said support surface and an elevated end of said first surface.

6. A game board as in claim 1, wherein said sub-areas are defined by upraised members associated with said front side of said support surface.

7. A game board as in claim 6, wherein said upraised members, both for said sub-areas and said shutter-like members, are integrally formed with said support surface.

8. A game board as in claim 1, wherein said support surface is substantially rectangular-shaped, and includes support means disposed on said back side thereof for supporting said surface above a given playing surface and at a desired angle relative thereto.

9. A game board as in claim 1, further including attachment means, disposed on said support surface back side, for separably attaching a pair of said game boards to one another in back-to-back relationship so as to facilitate portability and storage thereof.

10. A game board as in claim 9, wherein one of said sub-areas defines a primary scoring opening defined in said support surface, such openings for each respective game board being disposed for alignment with each other so as to provide a carrying handle for an attached pair of said game boards.

11. A game board as in claim 9, wherein an attached pair of said game boards define an enclosed cavity therebetween adapted for storage of playing pieces and removable legs therein, such legs being adapted for selected attachment to the back side of said game boards when separated for supporting same in an operative position for play.

12. A toss game playing board, adapted for providing an improved target surface for sack-type playing pieces, comprising:

a substantially planar and generally rectangular scoring surface;

a primary scoring opening generally centrally defined in said scoring surface;

a plurality of upraised wall-like members formed on said scoring surface and defining a scoring area substantially geometrically-disposed in a configuration generally directed towards said primary scoring opening; and a plurality of upraised members formed on said scoring surface and substantially uniformly disposed over portions thereof complementary to said scoring area and said scoring opening.

13. A board as in claim 12, wherein said upraised members are approximately in the range of from about ¼ to ⅜ of an inch tall, and include a progression of parallel members disposed perpendicular to the direction in which playing pieces are to be tossed thereat, said parallel members defining a longitudinal cross-section which is saw-tooth shaped.

14. A board as in 13, wherein said rectangular scoring surface is about 22 inches by 32 inches, and said scoring opening has an inside diameter of approximately six inches.

15. A board as in claim 12, wherein said scoring area includes respective non-parallel sidewall portions which collectively define a generally throat-like structure leading to said primary scoring opening, such structure intended to provide improved reception of playing pieces tossed in the direction of said scoring opening.

16. A board as in claim 12, further including a plurality of receptacles disposed on a reverse side of said scoring surface, and adapted for removably receiving leg members therein, whereby leg members of differing heights may be provided therein so as to elevate said board a predetermined height and at a predetermined angle from a given surface.

17. A board as in claim 12, further including attachment means, disposed on a reverse side of said scoring surface, for removably holding a pair of said substantially planar boards in generally planar-parallel relationship, with their respective scoring openings aligned so as to form a carrying handle to facilitate transportation of such an assembled pair of boards.

18. A game apparatus having a pair of separable target members adapted to receive similar but distinguishable playing pieces tossed thereat, said apparatus comprising:

a pair of generally planar target members separably engageable in back-to-back relationship for portability and storage thereof, and adapted to be placed in play positions when separated, wherein each of said target members have target surfaces which generally include a relatively centralized scoring opening, a structurally-designated scoring area, and a plurality of baffle-configured projections disposed on said target surface in complement to said scoring opening and scoring areas.

19. A game apparatus as in claim 18, wherein:

each of said target members further include sockets adapted for receipt of removable legs therein, which legs when in place dispose said target members in a raised, angled position for play; and further wherein said pair of target members when engaged define a cavity therebetween adapted for storage of such legs and for storage of playing pieces.

20. A game apparatus as in claim 18, wherein:

said scoring area is designated by upraised wall-like structures about ¼ inch thick and about ⅜ inch tall formed on said target surface and defining generally a triangle adjacent said scoring opening, which is substantially included within such triangle; and said projections comprise a plurality of parallel shutter-like members having upraised edges situated so as to engage playing pieces tossed thereat.

* * * * *